US010993019B2

(12) United States Patent
Kim et al.

(10) Patent No.: US 10,993,019 B2
(45) Date of Patent: Apr. 27, 2021

(54) DISPLAY APPARATUS

(71) Applicants: SAMSUNG ELECTRONICS CO., LTD., Suwon-si (KR); INCHEON NATIONAL UNIVERSITY RESEARCH & BUSINESS FOUNDATION, Incheon (KR)

(72) Inventors: Sungjoo Kim, Suwon-si (KR); Hoseon Ahn, Incheon (KR); Jongbae Kim, Suwon-si (KR); Namkeun Kim, Incheon (KR); Jihoon Kim, Incheon (KR); Dongkyu Park, Suwon-si (KR); Suntaek Lim, Incheon (KR)

(73) Assignees: Samsung Electronics Co., Ltd., Suwon-si (KR); INCHEON NATIONAL UNIVERSITY RESEARCH & BUSINESS FOUNDATION, Incheon (KR)

( * ) Notice: Subject to any disclaimer, the term of this patent is extended or adjusted under 35 U.S.C. 154(b) by 0 days.

(21) Appl. No.: 16/710,361

(22) Filed: Dec. 11, 2019

(65) Prior Publication Data

US 2020/0204907 A1 Jun. 25, 2020

(30) Foreign Application Priority Data

Dec. 19, 2018 (KR) ..... 10-2018-0164657

(51) Int. Cl.
*H04R 1/02* (2006.01)
*H04R 9/06* (2006.01)
*H04R 1/28* (2006.01)

(52) U.S. Cl.
CPC ..... *H04R 1/2811* (2013.01); *H04R 1/028* (2013.01); *H04R 2499/15* (2013.01)

(58) Field of Classification Search
CPC ..... H04R 1/2811; H04R 1/028
See application file for complete search history.

(56) References Cited

U.S. PATENT DOCUMENTS

2002/0051552 A1 5/2002 Schott
2015/0118482 A1* 4/2015 Kagawa ..... B32B 27/308 428/323

(Continued)

FOREIGN PATENT DOCUMENTS

CN 207589169 7/2018
KR 10-2011-0120050 A 11/2011

(Continued)

OTHER PUBLICATIONS

J.R. Wright, "The Virtual Loudspeaker Cabinet", J. Audio Eng. Soc., vol. 51, pp. 244-247.

(Continued)

*Primary Examiner* — Simon King
(74) *Attorney, Agent, or Firm* — Nixon & Vanderhye P.C.

(57) ABSTRACT

Disclosed is a display apparatus. The display apparatus comprises a display; and a speaker wherein the speaker comprises a driver configured to output sound based on an input sound signal; an enclosure surrounding a rear side of the driver; and an air adsorption member comprising graphene provided in the enclosure.

Based on the above, low-range reproduction capability of the speaker of the display apparatus may be improved and the degree of freedom in designing the speaker may be increased.

18 Claims, 13 Drawing Sheets

(56) References Cited

U.S. PATENT DOCUMENTS

| | | | | |
|---|---|---|---|---|
| 2015/0122800 | A1* | 5/2015 | Gallastegui | C01B 32/198 219/553 |
| 2016/0024681 | A1* | 1/2016 | Suh | C25D 3/38 205/50 |
| 2016/0345090 | A1* | 11/2016 | Wilk | H04R 1/288 |
| 2017/0064438 | A1* | 3/2017 | Wilk | H04R 1/2811 |
| 2017/0195781 | A1 | 7/2017 | Kang et al. | |
| 2019/0261084 | A1* | 8/2019 | Ozcan | H04R 3/04 |
| 2020/0092636 | A1* | 3/2020 | Sauer | H04R 1/02 |

FOREIGN PATENT DOCUMENTS

| | | | | |
|---|---|---|---|---|
| KR | 10-1502269 | B | 3/2015 | |
| KR | 10-2016-0019089 | | 2/2016 | |
| KR | 10-1645621 | B1 | 8/2016 | |
| KR | 10-1709078 | | 2/2017 | |
| WO | WO-2018002421 | A1 * | 1/2018 | H04R 3/04 |

OTHER PUBLICATIONS

International Search Report dated Apr. 29, 2020 for PCT/KR2019/017913.
Written Opinion dated Apr. 29, 2020 for PCT/KR2019/017913.

* cited by examiner

DISPLAY APPARATUS

CROSS-REFERENCE TO RELATED APPLICATION

This application is based on and claims priority under 35 U.S.C. § 119 to Korean Patent Application No. 10-2018-0164657, filed on Dec. 19, 2018, in the Korean Intellectual Property Office, the disclosure of which is incorporated by reference herein in its entirety.

BACKGROUND

Field

The disclosure relates to a display apparatus, for example, to a display apparatus including a speaker.

Description of Related Art

In recent years, electronic devices including a sound system such as television, Bluetooth speakers and mobile phones are getting slimmer. At the same, there is a growing demand for good sound quality.

Low-range reproduction capability greatly affects sound quality. One of the methods for improving low-range reproduction capability is to provide a large enclosure of a speaker. The larger an enclosure of a speaker is, the more advantageous it is to improve low-range performance because a resonant frequency of a sound system which is determined by an interaction between air within the enclosure and a diaphragm is lowered. That is, if air within the enclosure is modeled as a vibration system with a single degree of freedom, internal volume acts like a spring (hereinafter to be also called the "sound compliance"). If the volume is large, it is modeled as a flexible spring and the resonant frequency is lowered.

As the enclosure should be large to improve the low-range reproduction capability as above, it is not easy to improve the low-range reproduction capability in a relatively small speaker.

To address limitations of the sound compliance that is dependent upon the physical volume of the enclosure, a technology using active carbon or zeolite to have an effect of increasing a bulk of sound has been developed. The foregoing technology using active carbon or zeolite improves the sound compliance by discharging, condensing and adsorbing part of air within the enclosure to thereby prevent the sound compliance from being reduced according to a rise in a pressure within the enclosure when a diaphragm moves toward an inside of the enclosure. The foregoing technology has an effect opposite to the above when the diaphragm moves toward an outside of the enclosure and internal pressure of the enclosure is lowered.

However, as active carbon and zeolite are used in the form of granules (small grains) to maximize the effect of air adsorption, they should be isolated from a driver unit exposed in the enclosure. Also, active carbon and zeolite have less effect of air adsorption in high humidity, and thus they are mainly employed in a closed-type enclosure. If active carbon and zeolite are to be employed in an open-type enclosure, additional measures should be taken to prevent humidity. Also, although the pore size, specific surface area and density of adsorption materials should be controllable to maximize the effect of air adsorption, such control is not easy for zeolite and active carbon in general.

SUMMARY

Embodiments of the disclosure provide a display apparatus including an air adsorption member which may maximize and/or improve the effect of increasing a bulk of sound and may apply to various types of enclosures.

Accordingly, an example aspect of one or more example embodiments may provide a display apparatus comprising a display; and a speaker; wherein the speaker comprises a driver configured to output sound based on an input sound signal; an enclosure surrounding a rear side of the driver; and an air adsorption member comprising graphene provided in the enclosure.

The air adsorption member may include a scaffold to which graphene is attached.

The scaffold may include a grid.

The grids of the scaffold may have a space larger than the size of the graphene therebetween.

The scaffold may comprise least one of melamine foam, cellulose fiber matrix or metal mesh.

The graphene of the air adsorption member may be a powder attached to the scaffold.

The graphene of the air adsorption member may be attached to the scaffold using a volatile solution in which the graphene is dissolved.

The enclosure of the speaker may comprise at least one opening through which an inside of the enclosure and an outside of the enclosure communicate.

The air adsorption member may be arranged in parallel with, or perpendicularly to, the driver.

Another example aspect of one or more example embodiments may provide a speaker comprising a driver configured to output sound based on an input sound signal; an enclosure surrounding a rear side of the driver; and an air adsorption member comprising graphene.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
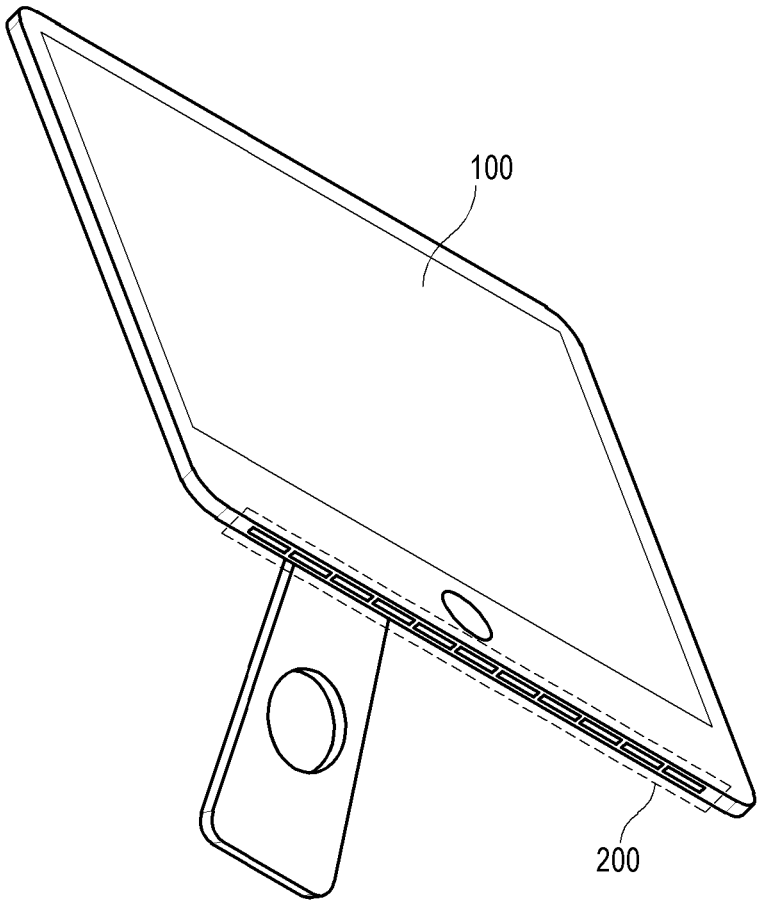
FIG. 1 is a diagram illustrating an example display apparatus according to an embodiment of the disclosure.

Below, various example embodiments of the disclosure will be described in greater detail with reference to accompanying drawings. In the drawings, the like reference numerals or signs may refer to elements that perform substantially the same functions, and the size of the respective elements may have been magnified for clarification and convenience of description. However, the technical ideas, configurations and effects of the disclosure are not limited to the configurations or effects described in the embodiments below. Embodiments which are described with reference to the drawings are not mutually exclusive unless otherwise specified and a plurality of embodiments may be selectively combined with each other for implementation. In the course of describing the disclosure, where any detailed description of known art or configuration relating to the disclosure is likely to unnecessarily deviate from substance of the disclosure, such detailed description may be omitted.

In the embodiments of the disclosure, terms including ordinal numbers such as first and second may be used simply for distinguishing an element from another element. The singular includes the plural unless the context explicitly otherwise requires. In the embodiments of the disclosure, terms "comprise", "include" and "have" should be understood as not excluding the possibility of existence or addition of one or more other characteristics, numbers, steps, operations, elements, parts or a combination of the same. In the embodiments of the disclosure, terms "upper", "top", "lower", "bottom", "left", "right", "above" and "below" are defined on the basis of the drawings, and the shape or location of the elements are not limited by the same. In addition, in the embodiments of the disclosure, the expression "at least one" of a plurality of elements refers to not only all of the plurality of elements but also each or a combination of the same excluding the remainder of the plurality of elements.

FIG. 1 is a diagram illustrating an example electronic device 100 according to an embodiment of the disclosure. The electronic device 100 according to the embodiment of the disclosure may be implemented as a display apparatus as illustrated in FIG. 1, e.g. as television, laptop computer, tablet PC, etc. However, the electronic device 100 according to the embodiment of the disclosure is not limited to a display apparatus, and may vary as long as it has a speaker, e.g. Bluetooth speaker and artificial intelligence speaker, etc., and outputs sound therethrough. The electronic device 100 according to the embodiment of the disclosure may be a speaker itself. However, hereinafter, the case where the electronic device 100 is a display apparatus will be described by way of example for convenience of description.

The display apparatus 100 according to the embodiment of the disclosure includes a speaker 200. The speaker 200 included in the display apparatus 100 of the disclosure may be a slot-type speaker. The slot-type speaker may refer, without limitation, to a speaker in which a cross-section area of an opening through which sound is output is smaller than a cross-section of a diaphragm of the speaker. The speaker 200 in FIG. 1 is provided in a lower part of the display apparatus 100 and thus a direction of outputting sound is also directed below the electronic device 100. However, the location of the speaker in the display apparatus 100 or the direction of outputting sound of the speaker 200 is not limited to the foregoing. Also, the speaker 200 of the disclosure is not limited to the slot-type speaker.

Figure 2:
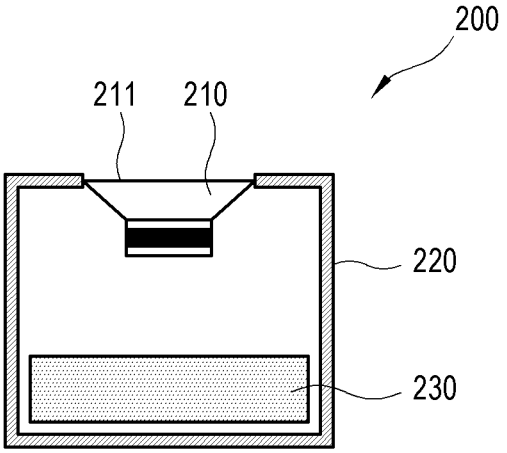
FIG. 2 is a cross-sectional view illustrating an example speaker according to an embodiment of the disclosure.

FIG. 2 is a cross-sectional view of the speaker 200 according to an embodiment of the disclosure. The speaker 200 according to the embodiment of the disclosure includes a driver unit (e.g., a driver) 210, an enclosure 220 and an air adsorption member 230.

The driver unit 210 may output sound according to a sound signal input to the driver unit 210. The driver unit 210 may be provided in the enclosure 220 or along with the enclosure 220. The driver unit 210 may be comprised of a single or plural drivers. The driver unit 210 may include a diaphragm 211 and a driving circuit (not shown) to output sound from a sound signal.

The enclosure 220 may refer, for example, to a structure forming a shape of the speaker, and accommodates the driver unit 210 therein. The enclosure 220 may surround a rear side of the driver unit 210. There is no specific limitation in the shape and material of the enclosure 220.

The air adsorption member 230 may include various air adsorption material and may be configured to adsorb air or discharge air adsorbed by it. The air adsorption member 230 may be provided in the enclosure 220. The air adsorption member 230 may include, for example, a graphene. The graphene may refer, for example, to a 2D membrane generated by a planar combination of carbon atoms and has various strengths such as high electron mobility, excellent mechanical strength and transparency. The air adsorption member 230 including the graphene adsorbs air in the enclosure 220 when the diaphragm 211 moves toward an inside of the enclosure 220, thereby preventing and/or avoiding a situation in which a sound compliance from being reduced according to a rise in an internal pressure of the enclosure 220. That is, the air adsorption member 230 creates the effect as if the bulk of the enclosure 220 has been substantially improved. On the other hand, the air adsorption member 230 may discharge air to an inside of the enclosure 220 when the diaphragm 211 moves toward an outside of the enclosure 220, thereby preventing and/or avoiding a situation in which the sound compliance from being increased according to a drop in pressure.

Based on the above, a low-range reproduction capability of the speaker 200 is improved.

Figure 3:
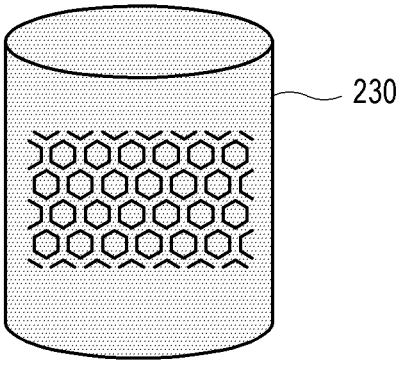
FIG. 3 is a diagram illustrating an example structure of an air adsorption member of the speaker according to an embodiment of the disclosure.

FIG. 3 is a diagram illustrating an example structure of the air adsorption member 230 of the speaker 200 according to the embodiment of the disclosure.

The air adsorption member 230 of the speaker 200 according to the embodiment of the disclosure may, for example, be implemented as a graphene sponge extending from a 2D graphene to a 3D structure or as a graphene platelet including several layers of graphene. FIG. 3 illustrates an example of the graphene sponge implementing the air adsorption member 230. If the air adsorption member 230 of the speaker 200 according to the embodiment of the disclosure is implemented as a graphene sponge or graphene platelet, the air adsorption member 230 may have a pore size effective for improving sound compliance through air adsorption and high specific surface area.

Based on the above, the low-range reproduction capability of the speaker 200 is further improved.

Figure 4:
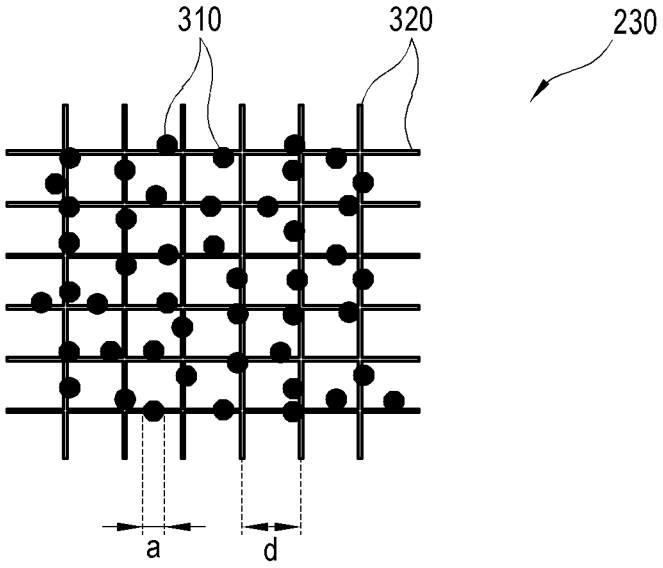
FIG. 4 is a diagram illustrating an example structure of an air adsorption member of a speaker according to an embodiment of the disclosure.

FIG. 4 is a diagram illustrating an example structure of an air adsorption member 230 of a speaker 200 according to an embodiment of the disclosure.

The air adsorption member 230 of the speaker 200 according to an embodiment of the disclosure may include a scaffold 320 as a structure to which a graphene 310 is attached. The scaffold 320 may, for example, have the graphene 310 attached thereto so that the graphene 310 does not freely move within the enclosure 220.

As illustrated in FIG. 4, the scaffold 320 may be provided in a grid form. However, the form of the scaffold 320 is not limited to the foregoing, and may vary as long as the graphene 310 is attached thereto. Even if the scaffold 320 is in a grid form, a space between grids or a length of each grid may be ununiform.

If the scaffold 320 is in a grid form, the space between the grids of the scaffold 320 may, for example, be larger than the size of the graphene 310. For example, if the graphene 310 attached to the scaffold 320 is in the form of, e.g. particles or powder as in FIG. 4, the space (d in FIG. 4) between the grids of the scaffold 320 may be larger than a diameter of the particle or powder (a in FIG. 4) of the graphene 310.

The scaffold 320 may be provided, for example, as at least one of melamine foam, cellulose fiber matrix and metal mesh. However, the material of the scaffold 320 is not limited to the foregoing.

Based on the above, the strength or durability of the air adsorption member 230 of the speaker 200 is improved.

If the air adsorption member 230 further includes the scaffold 320, various methods are available for attaching the graphene 310 to the scaffold 320.

For example, the air adsorption member 230 may be provided to attach the powder-type graphene 310 to the scaffold 320. Since the graphene 310 may have a size having a magnitude in nanometers it may be much smaller than the scaffold 320, if the scaffold 320 is dipped in a place where the graphene 310 is provided in the form of powder, the graphene 310 and the scaffold 320 may strongly adhere to each other by van der Waals force, etc. To further increase the contact between the graphene 310 and the scaffold 320 in the process of adhering the graphene 310 to the scaffold 320, an additional process of shaking or kneading the scaffold 320 by hand after putting the scaffold 320 in the place where the graphene 310 is provided in the form of powder may be performed.

Figure 5:
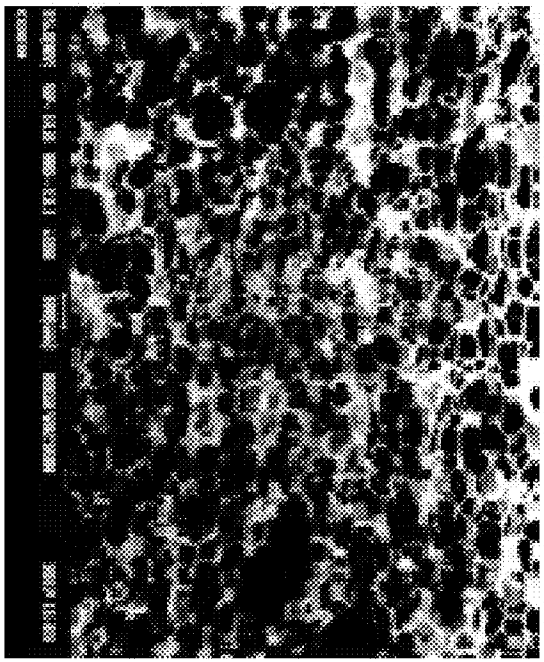
FIG. 5 is a photograph illustrating an example structure of the air adsorption member of the speaker according to an embodiment of the disclosure.
Figure 6:
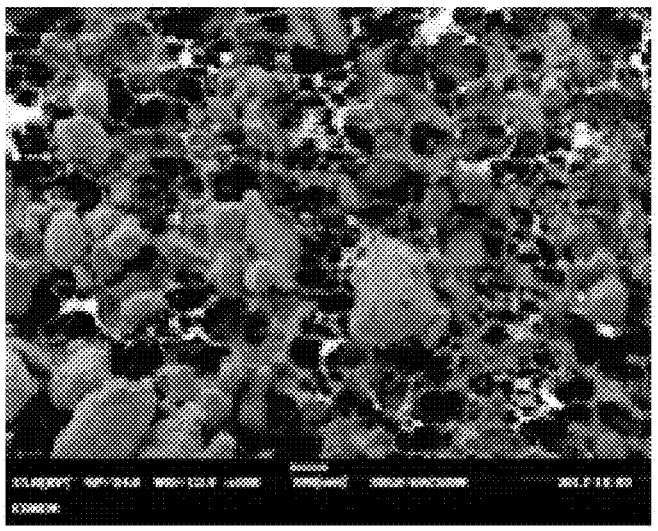
FIG. 6 is a photograph illustrating an example structure of the air adsorption member of the speaker according to an embodiment of the disclosure.

FIGS. 5 and 6 are photographs illustrating an example structure seen through a microscope when the graphene 310 in the form of powder is attached to the scaffold 320.

FIG. 5 relates to a first part of the air adsorption member 230.

FIG. 6 relates to a second part of the air adsorption member 230.

Based on the above, the air adsorption member 230 may be manufactured relatively easily without additional encapsulation process. Since the pore size, specific surface area, density, etc. of the air adsorption member 230 may be controlled by adjusting the space of the scaffold 320 or by varying the size of the powder of the graphene 310, the effect of air adsorption may be maximized and/or improved.

As another example of attaching the graphene 310 to the scaffold 320, the air adsorption member 230 may have the graphene 310 attached to the scaffold 320 using a volatile solution in which the graphene 310 is dissolved. For example, after the graphene 310 is dissolved in a volatile solution, the solution may be applied to the scaffold 320 by being sprinkled on the scaffold 320 or by dipping the scaffold 320 in the solution, and as the volatile solution is volatilized, the graphene 310 is attached to the scaffold 320.

Figure 7:
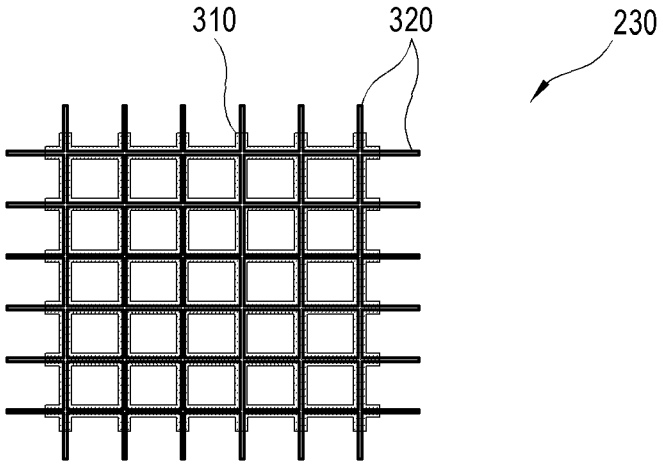
FIG. 7 is a diagram illustrating an example structure of an air adsorption member of a speaker according to an embodiment of the disclosure.

FIG. 7 is a diagram illustrating an example structure of the air adsorption member 230 that is provided by the foregoing attachment method.

Figure 8:
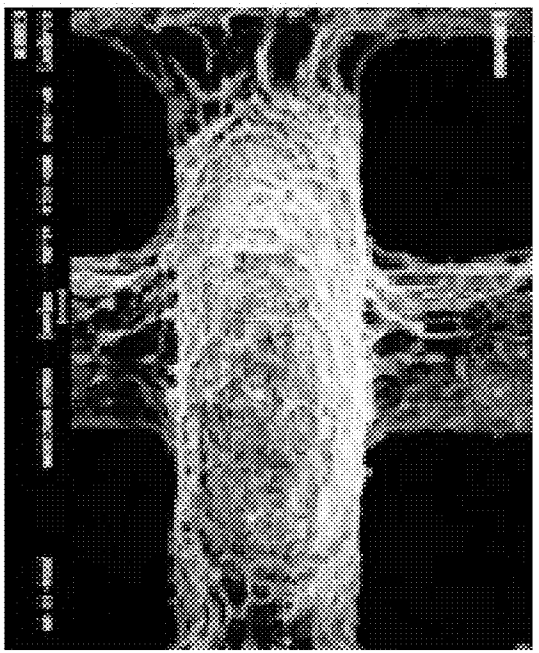
FIG. 8 is a photograph illustrating an example structure of the air adsorption member of the speaker according to an embodiment of the disclosure.

FIG. 8 is a photograph illustrating an example structure of FIG. 7 seen through a microscope.

Figure 9:
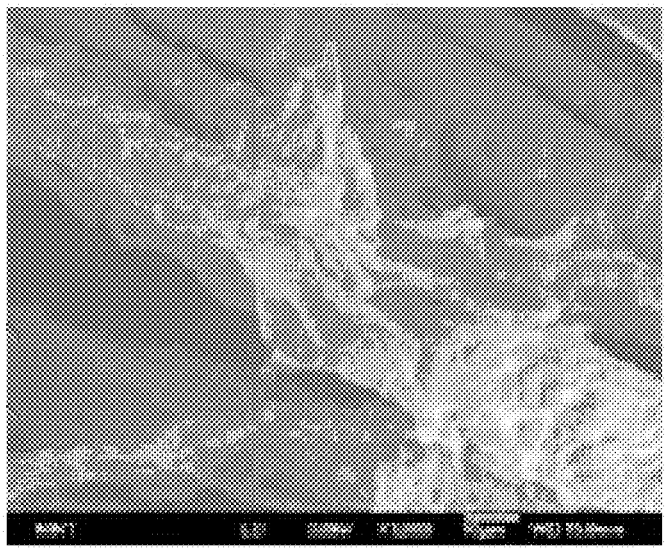
FIG. 9 is a photograph illustrating an example structure of the air adsorption member of the speaker according to an embodiment of the disclosure.

FIG. 9 is a photograph illustrating an example structure of FIG. 7 seen through a microscope. FIG. 9 illustrates the example structure of FIG. 7 seen through a microscope equipped with a higher resolution microscope than that used for FIG. 8.

Based on the above, the air adsorption member 230 may be manufactured relatively easily. Also, the effect of air adsorption may be maximized and/or improved by controlling the pore size, specific surface area and density of the air adsorption member 230.

Hereinafter, the effect of the disclosure will be described in greater detail below with reference to FIGS. 10, 11 and 12.

Figure 10:
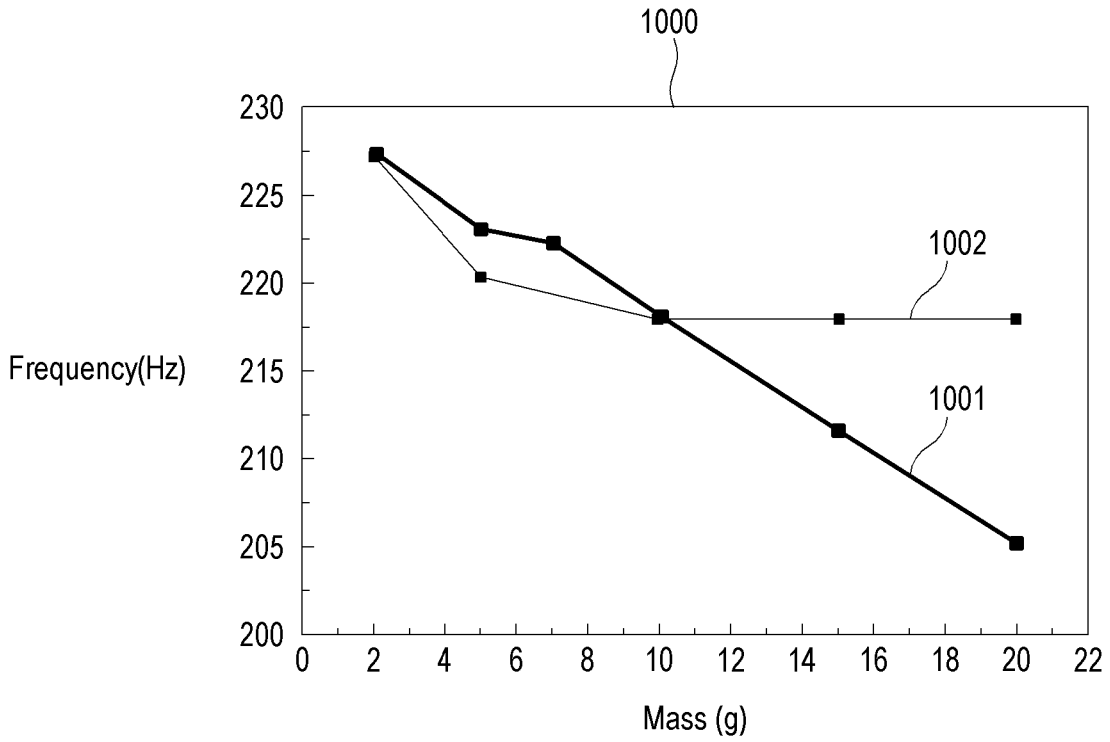
FIG. 10 is a diagram illustrating an effect of an embodiment of the disclosure.
Figure 10:
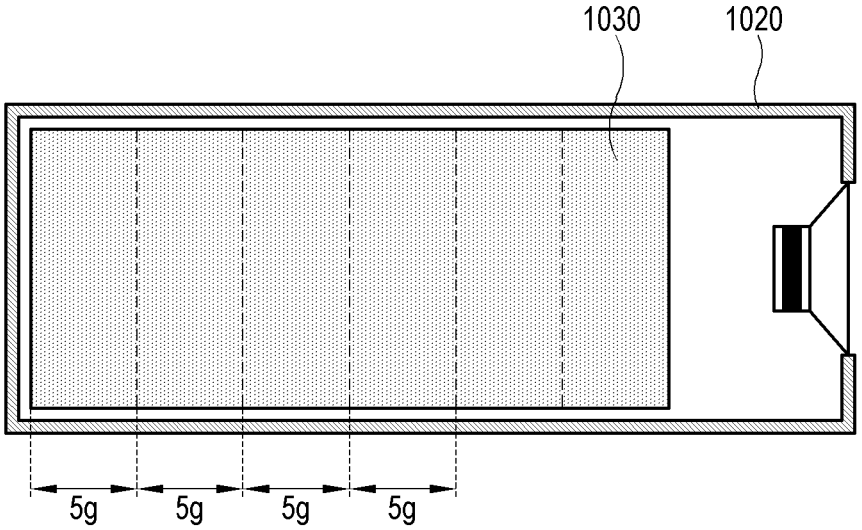

FIG. 10 is a diagram illustrating an example comparison between a graph 1002 which shows a change to a resonant frequency when the quantity of active carbon 1030 as an air adsorption member according to a prior art is increased within a closed-type enclosure 1020, and a graph 1001 which shows a change to a resonant frequency when the quantity of the air adsorption member 1030 including, e.g. graphene platelet (GP) according to the disclosure is increased. In the case of the air adsorption member including active carbon, the rate of increase in bulk is saturated at 20% while, in the case of the air adsorption member 1030 including GP, the resonant frequency is continuously reduced and the rate of increase in bulk is more than 40%. The rate of increase in bulk may refer, for example, to the percentage of the effect of increase in bulk of the enclosure 1020 corresponding to the amount of reduction of the resonant frequency. For example, the rate of increase in bulk may refer, for example, to the percentage of the effect of substantial increase in bulk through the air adsorption member with respect to the current volume of the enclosure 1020.

According to the disclosure, the rate of increase in bulk of the enclosure 1020 is higher than that of the prior art using active carbon, and thus the low-range reproduction capability may be further improved even in the enclosure 1020 with a limited volume.

Figure 11:
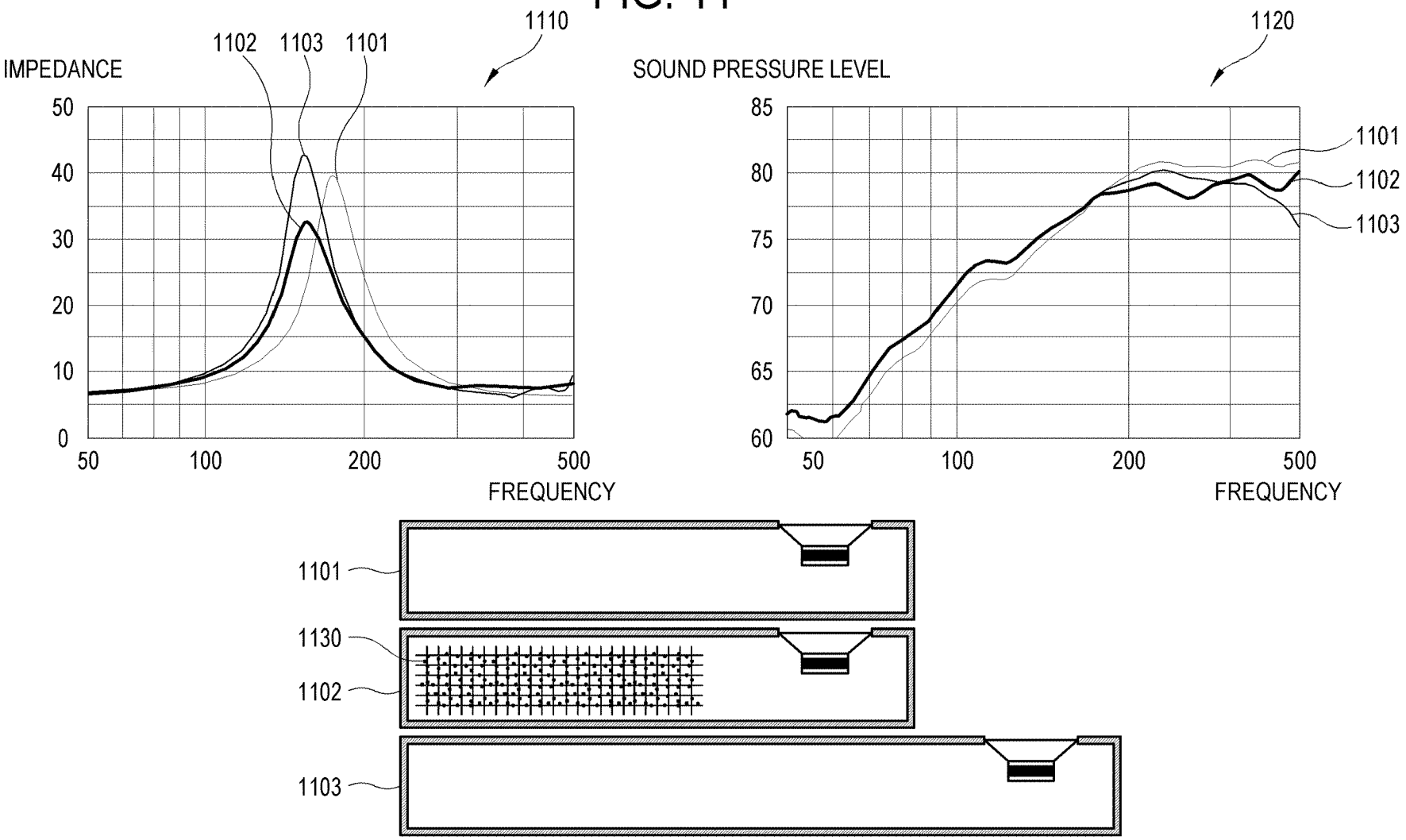
FIG. 11 is a diagram illustrating an example effect of an embodiment of the disclosure.

FIG. 11 is a diagram including various graphs showing changes to impedance and sound pressure level (SPL) of a prior speaker 1101 including an enclosure with a first volume, a speaker 1102 including the air adsorption member 1130 according to the disclosure within the enclosure with the first volume and a prior speaker 1103 including an enclosure with a second volume larger than the first volume. Although there is no specific limitation in the first and second volumes, it will be described hereinafter that the first volume and second volume are 350 cc and 500 cc, respectively, for convenience of description. Also, it is assumed that the air adsorption member 1130 has been provided by dipping melamine foam in a GP solution and then drying the same.

The left graph 1110 in FIG. 11 is a graph showing a change to an impedance depending on frequency, with respect to the foregoing three speakers 1101, 1102 and 1103. According to the left graph 1110 in FIG. 11, it can be shown that a peak frequency of an impedance curve with respect to the speaker 1102 including the air adsorption member 1130 according to the disclosure within the 350 cc enclosure is lower than a peak frequency of an impedance curve with respect to the prior speaker 1101 including the 350 cc enclosure, and that the degree of reduction of the peak frequency of the impedance curve is similar to the degree of increase of the volume of the enclosure of the prior speak from 350 cc to 500 cc.

The right graph 1120 in FIG. 11 shows changes to the SPL according to frequency, with respect to the three speakers 1101, 1102 and 1103. According to the right graph 1120 in FIG. 11, it can be shown that the SPL in a low band out of SPL graphs with respect to the speaker 1102 including the air adsorption member 1130 according to the disclosure within the 350 cc enclosure has been improved compared to the SPL in a low band of the SPL graphs with respect to the prior speaker 1101 including the 350 cc enclosure, and that the degree of improvement of the SPL in the low band is similar to the degree of increase of the volume of the enclosure of the prior speak from 350 cc to 500 cc.

That is, according to the embodiment of the disclosure, the bulk of the enclosure 1020 has been increased by approximately 40% compared to the prior art and therefore the low-range reproduction capability may be further improved even in the enclosure 1020 with a limited volume.

Figure 12:
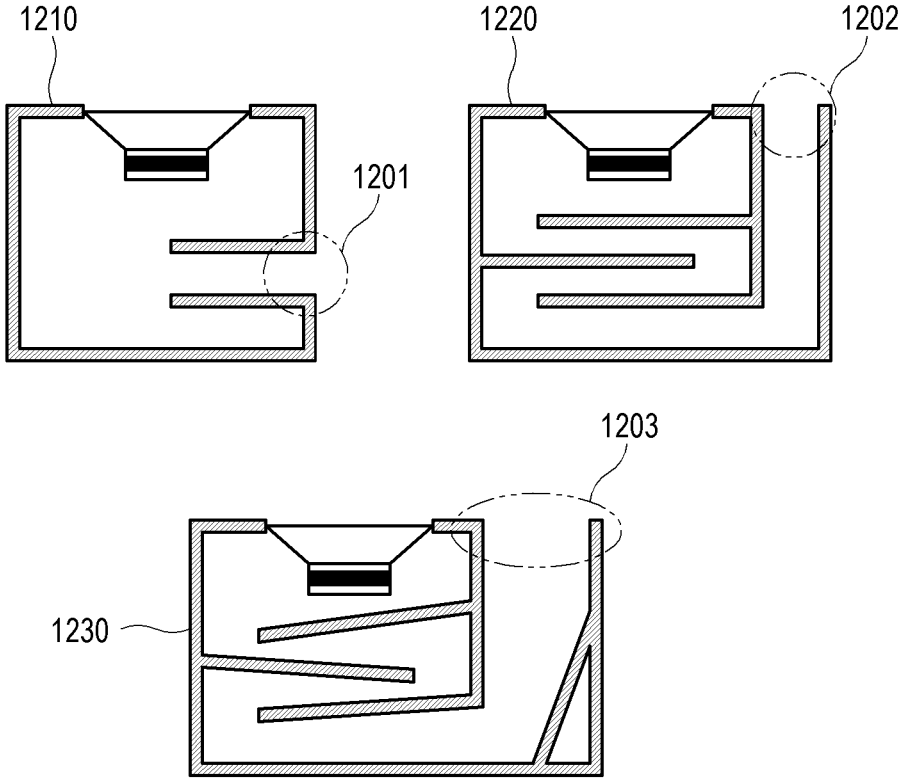
FIG. 12 is a diagram illustrating an example effect of an embodiment of the disclosure.

FIG. 12 is a diagram illustrating various example forms of the enclosure of the speaker according to an embodiment of the disclosure.

As shown therein, the enclosure of the speaker according to an embodiment of the disclosure may include at least one of openings 1201, 1202, 1203 through which an inside and an outside of the enclosure communicate with each other. For example, the speaker according to the embodiment of the disclosure may be implemented as a speaker including open-type enclosures 1210, 1220 and 1230. This is because the graphene included in the air adsorption member of the speaker according to the disclosure may be basically hydrophobic and may be less affected by humidity. For example, the speaker according to an embodiment of the disclosure not only applies to a closed-type enclosure but also may be implemented as a speaker including an open-type enclosure, and therefore is not subject to specific limitation of design of the enclosure.

Based on the above, the disclosure can be implemented through the speaker having an enclosure in various forms, and the degree of freedom is increased in designing the speaker.

Figure 13:
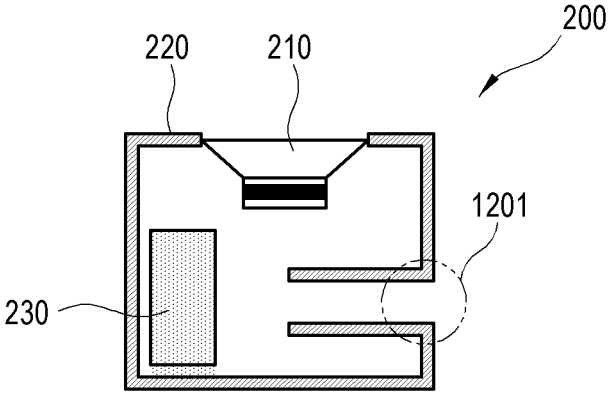
FIG. 13 is a cross-sectional view illustrating an example speaker according to an embodiment of the disclosure.

FIG. 13 is a cross-sectional view illustrating an example speaker 200 according to an embodiment of the disclosure.

In the speaker 200 according to the disclosure, there is no specific limitation in the location or direction of arrangement of the air adsorption member 230. For example, the speaker 200 according to an embodiment of the disclosure may be arranged in parallel with, or perpendicularly to, the driver unit 210. The location or direction of arrangement of the air adsorption member 230 may be decided based on the form or internal structure of the enclosure 220 or the desired degree of effect of air adsorption.

Based on the above, the effect of air adsorption is adjustable and the degree of freedom is increased in of designing the speaker 200 by adjusting the location of arrangement of the air adsorption member 230.

As described above, according to the disclosure, a low-range reproduction capability of a speaker of a display apparatus may be improved and the degree of freedom may be increased in designing the speaker.

Although a various example embodiments have been illustrated and described, it will be appreciated by those skilled in the art that various changes may be made in these example embodiments without departing from the principles, scope and spirit of the disclosure, including the appended claims and their equivalents.

Based on the above, low-range reproduction capability of the speaker is improved.

Based on the above, the strength or durability of the air adsorption member of the speaker is improved.

Based on the above, the air adsorption member may be manufactured relatively easily without an additional encapsulation process. Also, the effect of air adsorption may be maximized and/or improved by controlling a pore size, specific surface area, density, etc. of the air adsorption member.

Based on the above, the air adsorption member may be manufactured relatively easily. Also, the effect of air adsorption may be maximized and/or improved by controlling a pore size, specific surface area, density, etc. of the air adsorption member.

Based on the above, the disclosure may be implemented through various forms of speakers and thus the degree of freedom is increased in designing the speaker.

Based on the above, the effect of air adsorption is adjustable and the degree of freedom is also increased in designing the speaker by adjusting the location of arrangement of the air adsorption member.

What is claimed is:

1. A display apparatus comprising:
a display; and
a speaker;
wherein the speaker comprises:
a driver configured to output sound based on an input sound signal;
an enclosure surrounding a rear side of the driver; and
an air adsorption member comprising a scaffold provided on the rear side of the driver and comprised of a structure in a grid form to which graphene can be attached.

2. The display apparatus according to claim 1, wherein the scaffold has a grid form.

3. The display apparatus according to claim 2, wherein a space between grids of the scaffold is larger than a size of the graphene.

4. The display apparatus according to claim 1, wherein the scaffold comprises at least one of melamine foam, cellulose fiber matrix or metal mesh.

5. The display apparatus according to claim 1, wherein the air adsorption member comprises graphene powder attached to the scaffold.

6. The display apparatus according to claim 1, wherein the graphene of the air adsorption member is attached to the scaffold using a volatile solution in which the graphene is dissolved.

7. The display apparatus according to claim 1, wherein the enclosure of the speaker comprises at least one opening through which an inside of the enclosure and an outside of the enclosure communicate.

8. The display apparatus according to claim 1, wherein the air adsorption member is arranged in parallel with, or perpendicular to, the driver.

9. A speaker comprising:
a driver configured to output sound based on an input sound signal;
an enclosure surrounding a rear side of the driver; and
an air adsorption member comprising a scaffold provided on the rear side of the driver and comprised of a structure in a grid form configured so that graphene can be attached thereto.

10. The display apparatus according to claim 1, wherein the enclosure includes a first opening on a first side of the enclosure and in which at least a portion the driver is disposed and the air adsorption member is disposed inside the enclosure and near a second side of the enclosure opposite to the first side.

11. The display apparatus according to claim 1, wherein the enclosure includes a first opening on a first side of the enclosure and in which at least a portion the driver is disposed, a second opening on a second side of the enclosure and through which an inside of the enclosure and an outside of the enclosure communicate, and the air adsorption member is disposed inside the enclosure and near a third side of the enclosure opposite to the second side.

12. The speaker according to claim 9, wherein the scaffold has a grid form.

13. The speaker according to claim 12, wherein a space between grids of the scaffold have a size larger than a size of the graphene.

14. The speaker according to claim 9, wherein the scaffold comprises at least one of melamine foam, cellulose fiber matrix or metal mesh.

15. The speaker according to claim 9, wherein the air adsorption member comprises graphene powder attached to the scaffold.

16. The speaker according to claim 9, wherein the graphene of the air adsorption member is attached to the scaffold using a volatile solution in which the graphene is dissolved.

17. The speaker according to claim 9, wherein the enclosure of the speaker comprises at least one opening through which an inside of the enclosure and an outside of the enclosure communicate.

18. The speaker according to claim 9, wherein the air adsorption member is arranged in parallel with, or perpendicular to, the driver.

* * * * *